US006623415B2

(12) United States Patent
Gates et al.

(10) Patent No.: US 6,623,415 B2
(45) Date of Patent: Sep. 23, 2003

(54) SHEET FOLDING SYSTEMS AND METHODS

(75) Inventors: Jon A. Gates, Honey Creek, IA (US); Fred C. Casto, Omaha, NE (US)

(73) Assignee: First Data Corporation, Englewood, CO (US)

( * ) Notice: Subject to any disclaimer, the term of this patent is extended or adjusted under 35 U.S.C. 154(b) by 0 days.

(21) Appl. No.: 10/029,122

(22) Filed: Dec. 21, 2001

(65) Prior Publication Data

US 2003/0119642 A1 Jun. 26, 2003

(51) Int. Cl.[7] ..... B31F 1/08

(52) U.S. Cl. ..... 493/425; 493/356; 493/405; 493/440; 493/444

(58) Field of Search ..... 493/356, 357, 493/358, 359, 360, 405, 419, 421, 437, 440, 444

(56) References Cited

U.S. PATENT DOCUMENTS

| | | | | | |
|---|---|---|---|---|---|
| 3,773,314 | A | * | 11/1973 | Giovannini | 493/18 |
| 3,905,593 | A | * | 9/1975 | Behn | 493/17 |
| 4,643,705 | A | * | 2/1987 | Bober | 493/444 |
| 4,905,977 | A | * | 3/1990 | Vijuk | 270/45 |
| 5,076,556 | A | * | 12/1991 | Mandel | 270/45 |
| RE34,483 | E | * | 12/1993 | Bowman et al. | 101/138 |
| 5,327,701 | A | | 7/1994 | Dronsfield | |
| 5,667,210 | A | * | 9/1997 | DeLise, Jr. | 270/37 |
| 5,704,602 | A | * | 1/1998 | Taylor et al. | 270/1.02 |
| 5,709,374 | A | * | 1/1998 | Taylor et al. | 270/1.02 |
| 6,074,332 | A | * | 6/2000 | Helmstadter et al. | 493/254 |
| 6,094,894 | A | | 8/2000 | Yates | |
| 6,164,043 | A | | 12/2000 | Miller et al. | |
| 6,202,005 | B1 | | 3/2001 | Mahaffey | |
| 6,273,411 | B1 | * | 8/2001 | Vijuk | 270/37 |
| 6,276,677 | B1 | * | 8/2001 | Hommochi et al. | 270/32 |
| 6,309,336 | B1 | * | 10/2001 | Muessig et al. | 493/444 |

* cited by examiner

*Primary Examiner*—Rinaldi I. Rada
*Assistant Examiner*—Hemant M. Desai
(74) *Attorney, Agent, or Firm*—Townsend and Townsend and Crew, LLP

(57) ABSTRACT

The present invention provides exemplary sheet folding systems and methods, including systems and methods for printing on a continuous sheet, and removing and folding individual sheets from the continuous sheet. In one embodiment, a sheet folding system (100) includes a separator (200) adapted to separate an individual sheet from a continuous form sheet, a receiver (300) adapted for receiving the individual sheet, a first folder (500) adapted to perform a first fold of the individual sheet, and a second folder (800) adapted to perform a second fold of the individual sheet. In some embodiments, the first and second folders include two different types of folders.

27 Claims, 12 Drawing Sheets

SHEET FOLDING SYSTEMS AND METHODS

CROSS-REFERENCES TO RELATED APPLICATIONS

This case is related to the following U.S. Patent Applications, each of which is assigned to the assignee of the present invention and each of which is incorporated herein by reference:

a) U.S. patent application Ser. No. 10/045,589 entitled "SYSTEM AND METHODS OF PROVIDING INSERTS INTO ENVELOPES," filed on Nov. 8, 2001;

b) U.S. patent application Ser. No. 10/036,653 entitled "MAIL HANDLING EQUIPMENT AND METHODS," filed on Nov. 8,2001; and c) U.S. patent application Ser. No. 10/028,449 entitled "INTELLIGENT INSERTING SYSTEMS AND METHODS," filed on Dec. 19, 2001.

BACKGROUND OF THE INVENTION

The present invention is directed to sheet folding systems and methods, and more particularly, to systems and methods for folding sheets, such as paper statements, inserts and the like, for subsequent insertion into envelopes.

Financial institutions, long distance telephone companies, and a number of other organizations frequently send paperwork to existing or potential customers. For example, a credit card customer may receive monthly statements, informational inserts, sheets of convenience checks, and the like. In some circumstances, the paperwork accompanies a card, such as a credit card or the like, mounted in or to a card carrier. In order to send the paperwork and/or card to a customer, the information may be sent first to a third party organization for processing and mailing. One such organization is First Data Merchant Services Corporation (FDMS).

Mail processing systems are currently used to mail, for example, a sheet of convenience checks to a customer. Current systems typically will print the checks on an individual sheet of paper, stack large numbers of sheets in a bin, individually retrieve each sheet and then fold the sheet to fit into an envelope. The high volume of mailings, however, makes this an expensive process. The process of printing on individual sheets can be particularly expensive.

The present invention relates to machines and techniques that address at least some of the problems of the current processing equipment.

BRIEF SUMMARY OF THE INVENTION

The present invention provides exemplary sheet folding systems and methods, including systems and methods for printing on a continuous sheet, and removing and folding individual sheets from the continuous sheet. In some embodiments, the folded sheets are subsequently inserted into an envelope.

In one embodiment of the present invention, a sheet folding system includes a separator adapted to separate an individual sheet from the continuous form sheet, a receiver adapted for receiving the individual sheet, a first folder adapted to perform a first fold of the individual sheet, and a second folder adapted to perform a second fold of the individual sheet. In some embodiments, the first and second folders include two different types of folders.

In a particular embodiment, the first folder is a knife folder. In one aspect, the knife folder includes a knife blade coupled to a movement mechanism, such as a pneumatic movement mechanism, and a pair of rollers adapted to at least partially receive the knife blade and the individual sheet therebetween. The knife folder also includes a deflector positioned on a side of the pair of rollers that is generally opposite the knife blade, with the deflector adapted to deflect the individual sheet having the first fold. In this manner, the knife folder may be used to create a first fold in an individual sheet that originated from a continuous form sheet.

In some aspects of the present invention, the first fold is a fold of the individual sheet along a first direction, with the second fold being a fold along a second direction. In one aspect, the first and second directions are generally orthogonal. The second fold may be a wide range of fold types, including but not limited to a half fold, a C-fold and a Z-fold. The second folder includes a buckle plate folder in one aspect.

In one embodiment, a printer adapted for printing alphanumeric characters on the continuous form sheet is coupled to the separator. In another embodiment, the sheet folding system includes an inserter coupled to the second folder, with the inserter adapted to insert the folded individual sheet into an envelope.

In a particular aspect, a system of the present invention includes a sheet transfer mechanism coupled to and between the first and second folders. The sheet transfer mechanism defines a generally right angle alignment between the two folders. In other embodiments, the sheet folding system includes a controller coupled to the first and second folders and/or an edge remover for removing an edge of the individual sheet(s).

In another embodiment, a sheet folding system includes a receiver adapted for receiving a sheet to be folded, and a knife folder coupled to the receiver and adapted to perform a first fold of the sheet. The knife folder includes a knife blade coupled to a pneumatic movement mechanism, and a pair of rollers and a deflector as described above. In one aspect, the sheet folding apparatus further includes a separator for separating an individual sheet to be folded from the continuous form sheet, with the receiver adapted for receiving the individual sheet.

The present invention further includes methods of folding a sheet of paper. One such method includes printing on a continuous form sheet, separating an individual sheet from the continuous form sheet, performing a first fold of the individual sheet with a knife folder, and performing a second fold of the individual sheet with a second folder. The method may include inserting the folded individual sheet into an envelope with an inserter that is coupled to the second folder.

Other objects, features and advantages of the present invention will become more fully apparent from the following detailed description, the appended claims and the accompanying drawings.

DETAILED DESCRIPTION OF THE INVENTION

Figure 1:
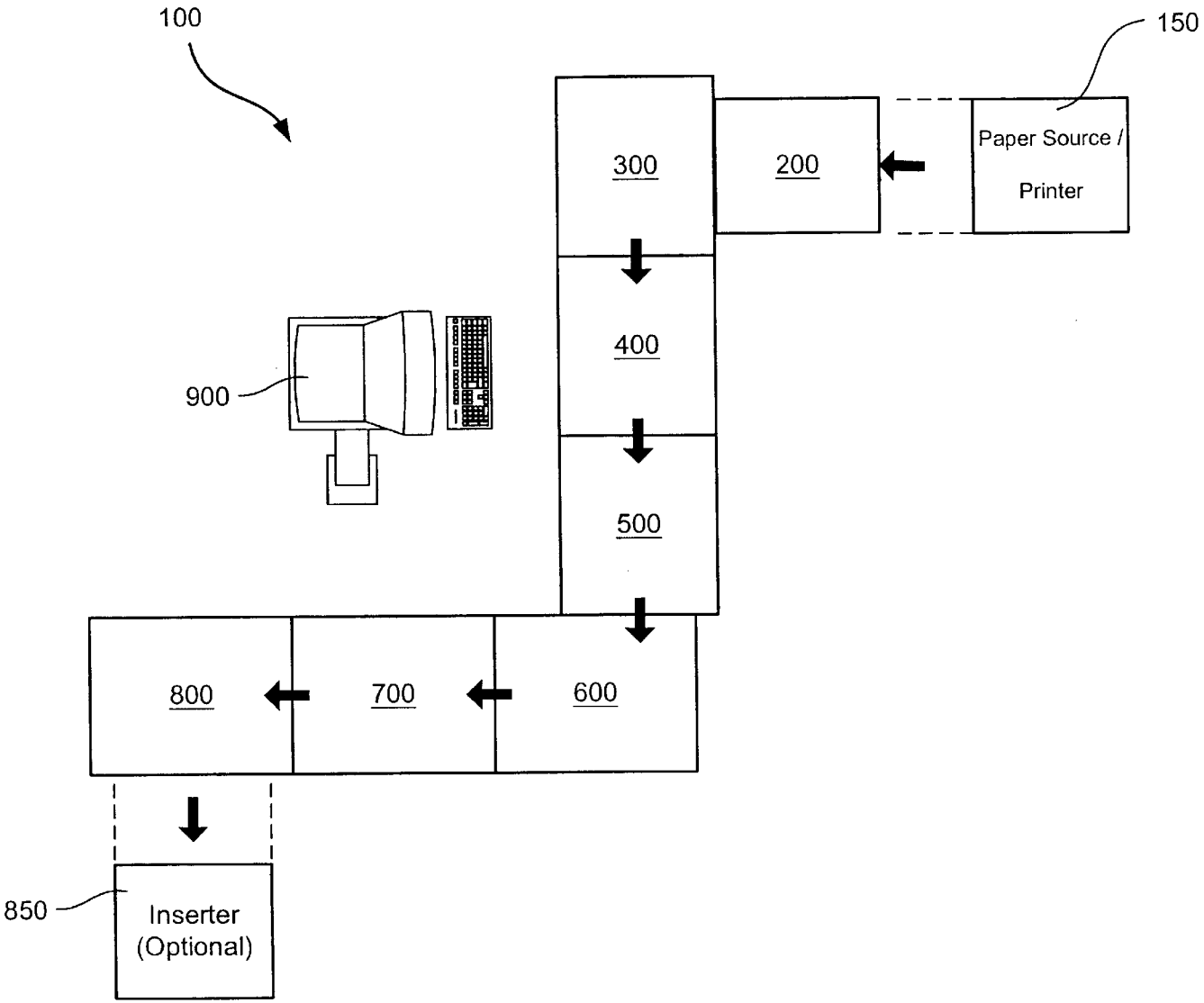
FIG. 1 is a simplified schematic of a sheet folding system according to an embodiment of the present invention.

FIG. 1 depicts a simplified schematic of a sheet folding system 100 according to the present invention. System 100 includes a series of stations adapted to produce a folded sheet ready to be inserted into an envelope for mailing. Documents or sheets processed by system 100 include one or more sheets of paper, such as a customer billing statement, a new cardholder agreement, convenience checks, and the like. Documents also may include a variety of paper inserts, such as advertisements and the like, which require folding.

Turning now to FIG. 1, one embodiment of a sheet folding system 100 according to the present invention will be described. System 100 includes a receiver 300 adapted for receiving paper from a paper source 150. Paper source 150 may include, or be coupled to a printer for printing customer documents. The printer may print, for example, alphanumeric characters to identify the customer, the customer's address, the customer's billing information, and the like. The printer further may print bar codes and other identifying marks on the documents. In one embodiment, paper source 150 is a continuous form paper source. In this manner, paper source 150 provides for the continuous printing of statements, convenience checks or the like for multiple customers.

In one embodiment, the continuous form sheet is fed into a separator 200. Separator 200 cuts or separates a sheet to be folded from the continuous form sheet in order to, for example, distinguish one customer's documents from a second customer's documents. Separator 200 also may remove an edge of the individual sheet, such as a perforated edge, tractor pins, or the like. In one embodiment, separator 200 is a Laurenti Cutter, commercially available from EMC Document Systems, Inc., having its headquarters in Batavia, Ill. The individual sheet is received from separator 200 by a receiver 300. In this manner, a printer coupled to paper source 150 may print multiple customer documents in series, with receiver 300 receiving documents for one customer separately from the documents for another customer. Receiver 300 transfers the sheet to a first folder 500, by way of a first sheet translation component 400. In another embodiment, receiver 300 transfers the sheet directly to first folder 500.

First folder 500 performs a first fold of the paper sheet. The folded paper sheet is transferred to a second folder 800 by way of a second sheet translation component 600 and a third sheet translation component 700. As shown in FIG. 1 in one embodiment, translation components 600 and 700 are configured such that system 100 has an approximate ninety degree (90°) turn for sheets processed therethrough. In this manner, system 100 maintains a small footprint. Further, in one embodiment the ninety degree turn helps align the sheet for subsequent folds.

Second folder 800 performs a second fold of the paper sheet. In some embodiments, second folder 800 folds the sheet both a second and a third time. For example, second folder 800 may perform a half-fold of the folded sheet, a C-fold, a Z-fold, or the like. In one embodiment, an inserter system 850 is coupled to second folder 800. In this manner, the folded sheet may be transferred from second folder 800 to inserter 850 for subsequent insertion into an envelope or the like. Sheet processing times may vary through system 100. In one embodiment, the amount of time it takes a sheet received by receiver 300 to travel through system 100, including through second folder 800, is less than 0.5 seconds. In a particular embodiment, the sheet passes from receiver 300 though second folder 800 in about 400 milliseconds. System 100 is controlled by a controller 900, which is electrically coupled to system 100.

Figure 2A:
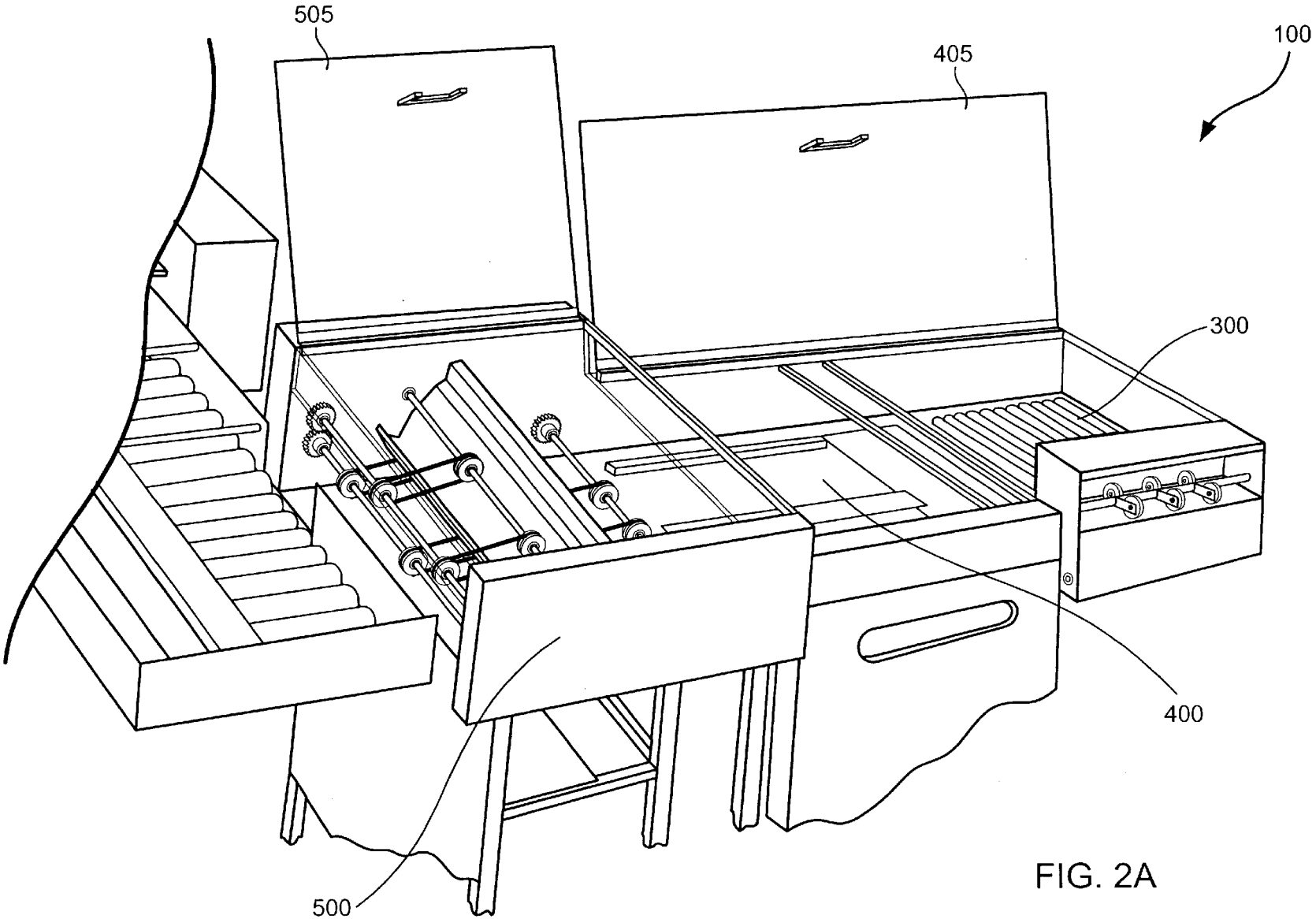
FIGS. 2A and 2B are simplified overall views of two portions of a sheet folding system according to the present invention.
Figure 2B:
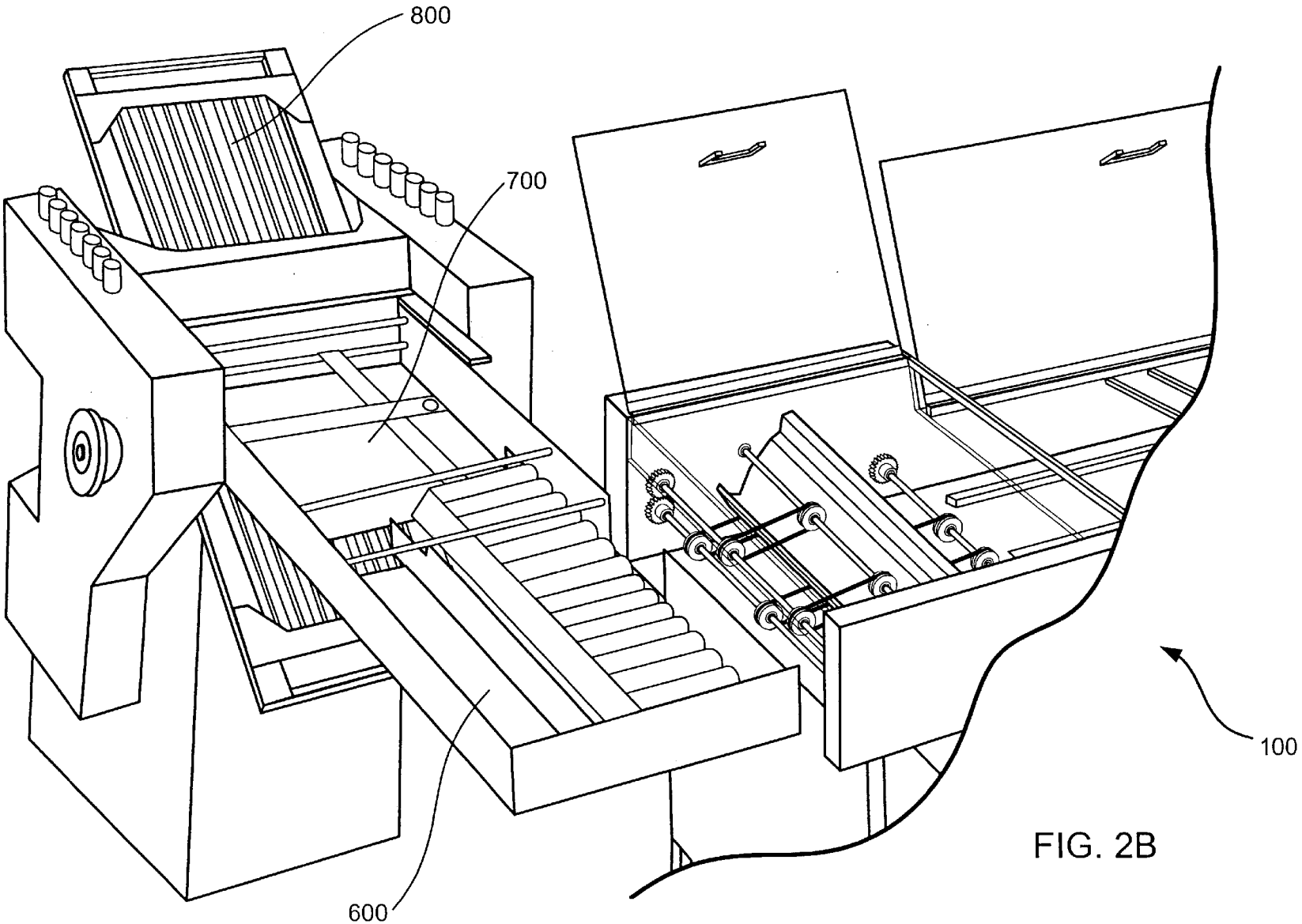
Figure 3:
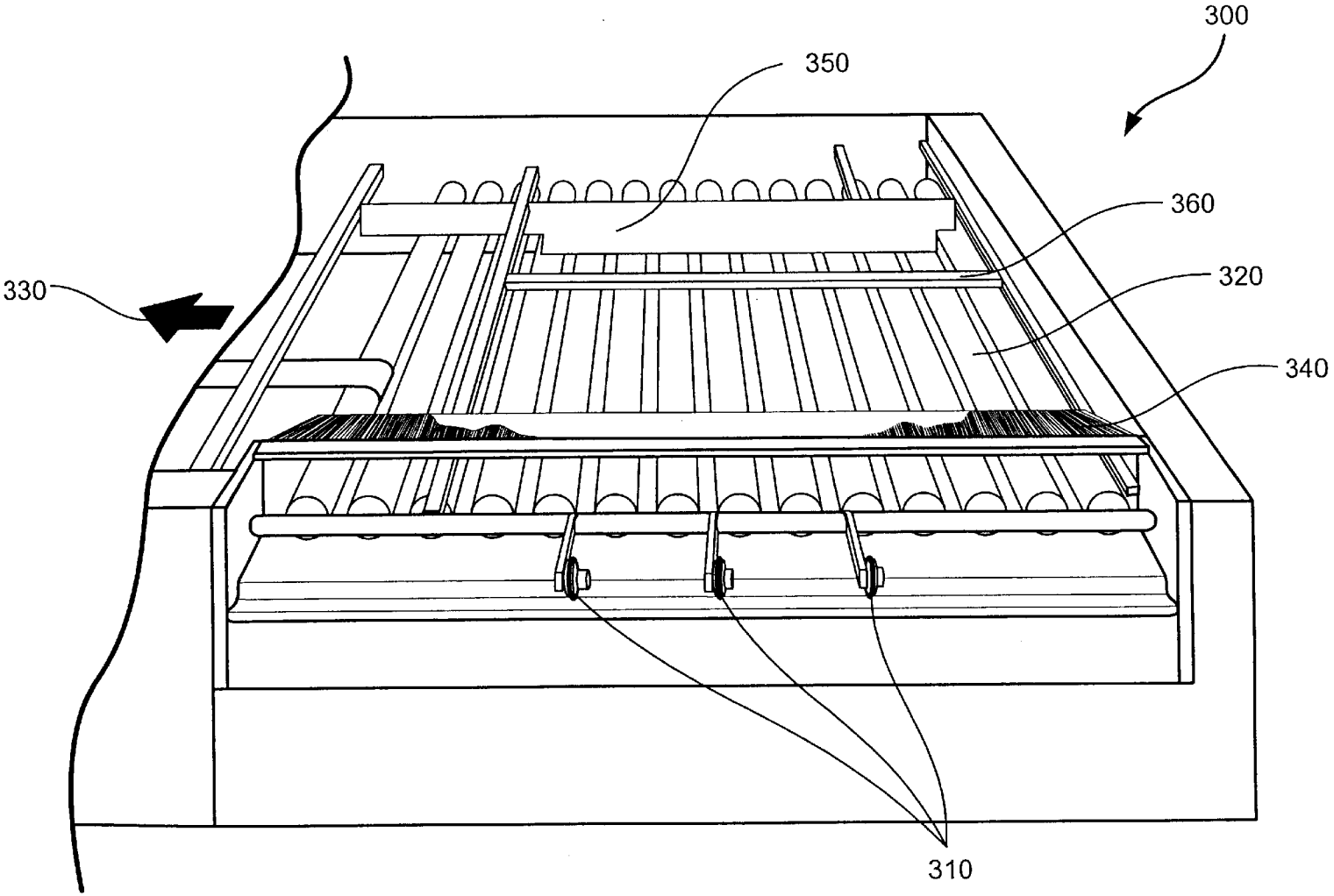
FIG. 3 is a simplified overall view of a receiver as part of the sheet folding system of FIGS. 1–2B.

FIGS. 2A and 2B depict one embodiment of system 100 according to the present invention. As best seen in FIG. 2A and FIG. 3, receiver 300 has two or more entry rollers 310 which are designed to grasp a paper sheet (not shown) to be processed by system 100. In one embodiment, entry rollers 310 grasp a continuous form sheet of paper from paper source 150, with receiver 300 subsequently separating an individual sheet from the continuous form sheet. In another embodiment, rollers 310 grasp an individual sheet from separator 200.

Receiver 300 has a plurality of rollers 320 onto which the individual sheet is drawn by rollers 310. As the individual sheet enters receiver 300, it engages one or more brush bars 340 to help maintain the sheet on rollers 320. Further, the sheet is drawn by rollers 310 across rollers 320 so that the sheet engages a plate 350. The sheet is registered against plate 350, to facilitate proper alignment of the sheet prior to being transferred to first folder 500.

In one embodiment, a bar 360 is positioned above rollers 320. Bar 360 includes one or more ports for blowing a fluid, such as air, down onto the sheet. In this manner, the air helps maintain the paper sheet against rollers 320. Bar 360 is coupled to a fluid source (not shown). The fluid source provides compressed air or other gases or fluids to bar 360, which are blown or directed toward the paper sheet on rollers 320. Rollers 320 are adapted to rotate in a counterclockwise direction as shown in FIG. 3. Rollers 320 transfer the paper sheet received by receiver 300 to the left as indicated by arrow 330.

Figure 4:
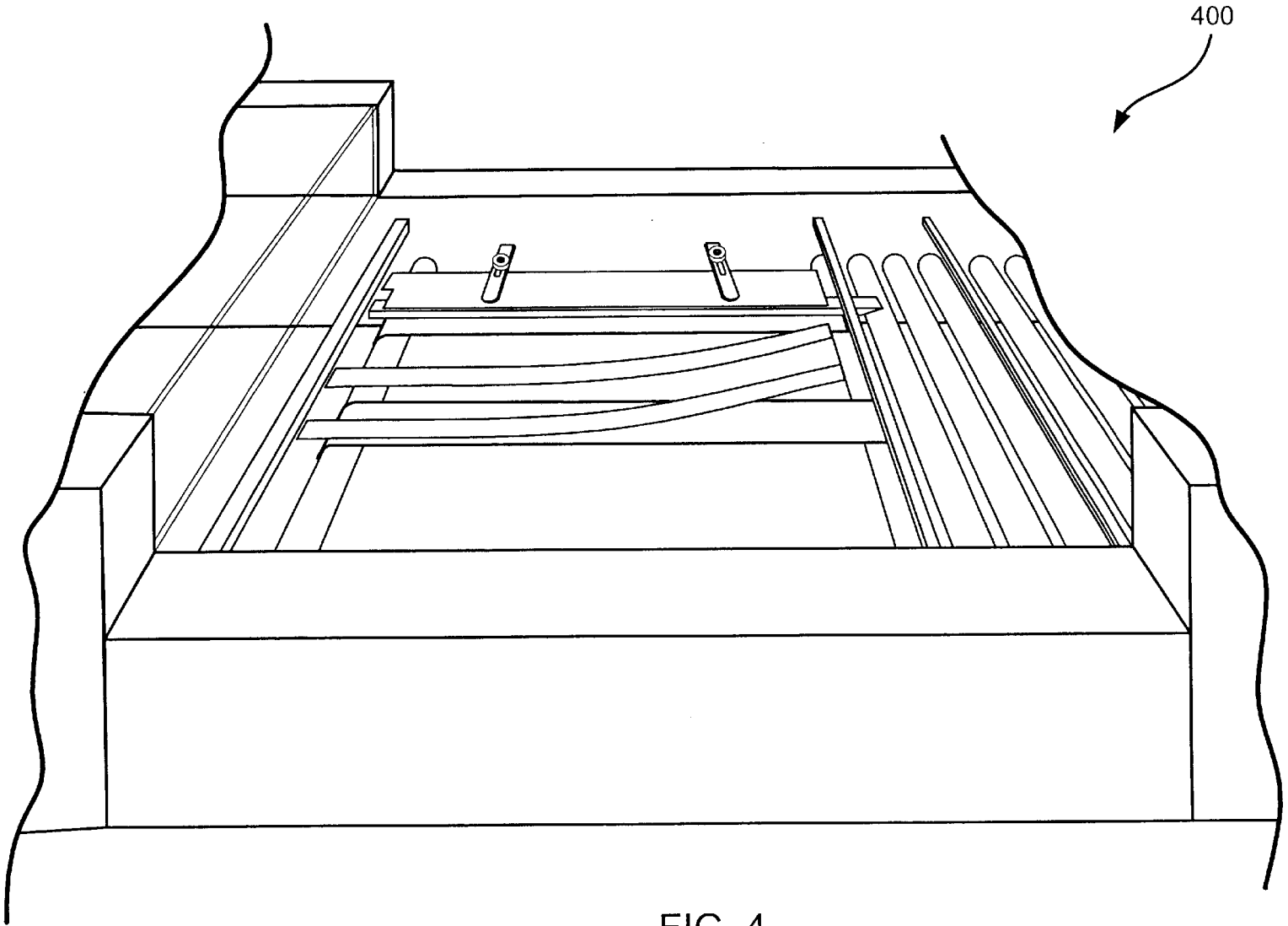
FIG. 4 is a simplified overall view of a sheet translation component of the system of FIGS. 1–2B.

As can be seen in FIG. 2A and FIG. 4, first sheet translation component 400 permits the transfer of the individual sheet from receiver 300 to first folder 500. In one embodiment, a lid 405 is coupled to receiver 300 and first sheet translation component 400, and preferably remains closed during operation. In one embodiment, cover 405 is translucent. In another embodiment, receiver 300 and translation component 400 have separate lids.

In another embodiment of the present invention, system 100 does not include first sheet translation component 400. In this embodiment, receiver 300 is directly coupled to first folder 500. The paper sheet is transferred to first folder 500 by rollers 320.

As can be seen in FIG. 2A, a first folder 500 receives the individual sheet from translation component 400, or from receiver 300. First folder 500 has a lid 505 (FIG. 2A). In one embodiment, lid 505 is translucent to allow visual access to folder 500 when lid 505 is closed during system 100 operation. In one embodiment, first folder 500 is a knife folder.

Figure 5A:
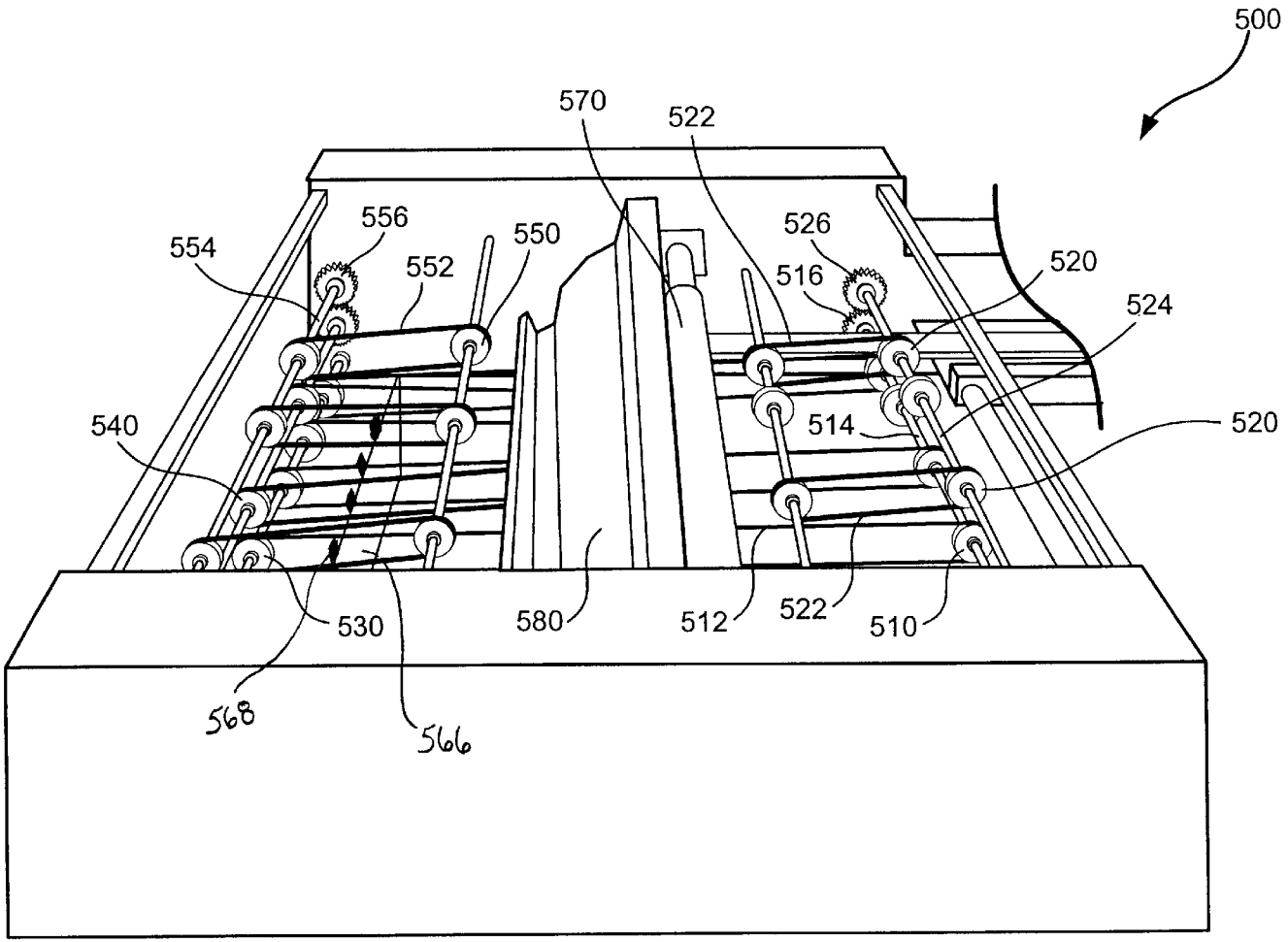
FIG. 5A depicts a portion of a knife folder according to the present invention.
Figure 5B:
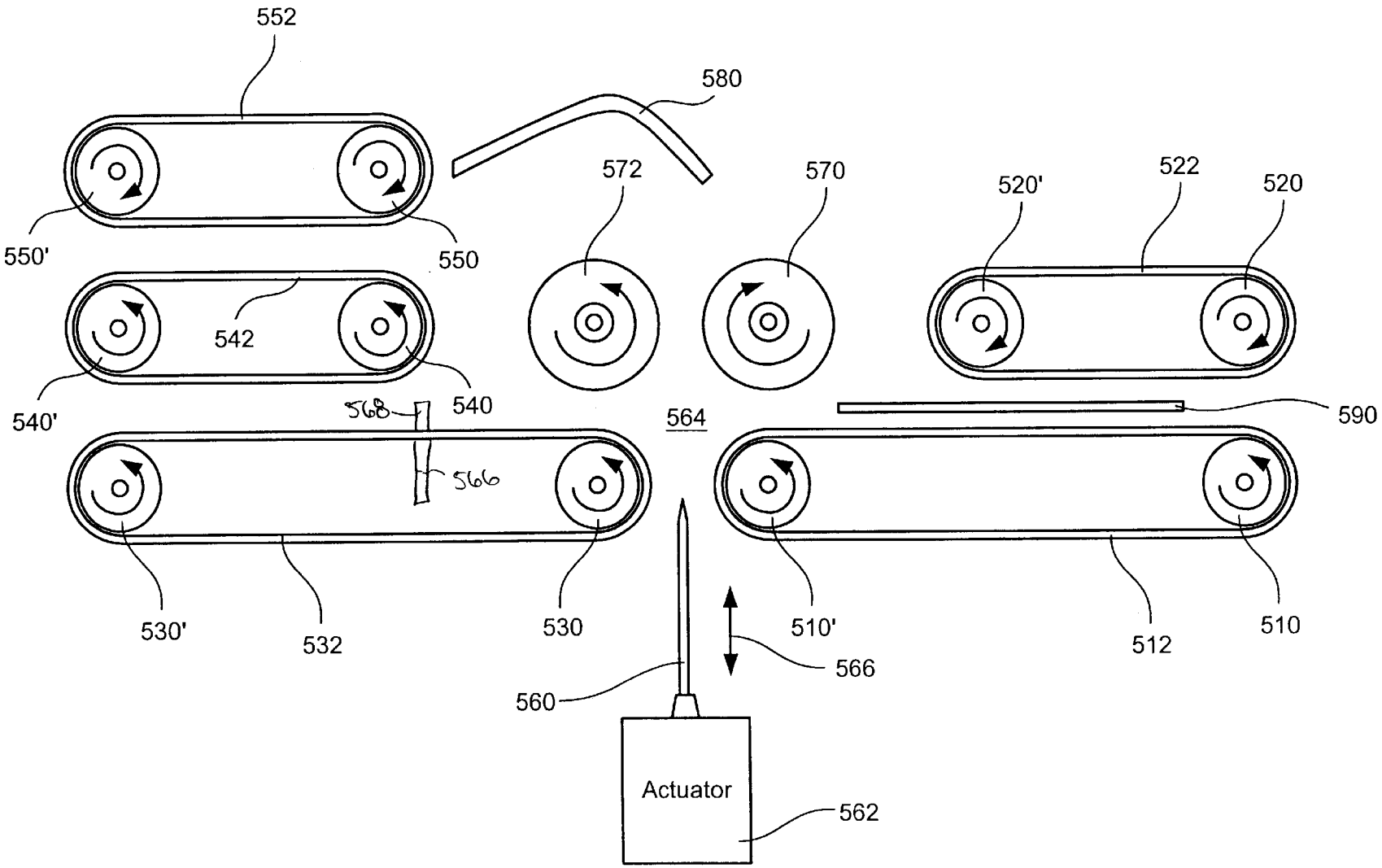
FIGS. 5B–5D are simplified side views of the knife folder of FIG. 5A, depicting an individual sheet at various positions therein.

As best seen in FIGS. 5A and 5B, a paper sheet 590 is received between a first set of rollers 510 and a second set of rollers 520. Rollers 520 are each coupled to a bar or axle 524 having a gear 526 disposed near one or both ends of bar 524. Gear 526 may be driven or rotated by a wide range of rotation devices (not shown). Similarly, rollers 510 are coupled to a bar or axle 514 having a gear 516 disposed near one or both ends of bar 514. As can be seen in FIG. 5A, in one embodiment gears 516 and 526 interact to produce opposite rotations of bars 524 and 514, and hence opposite rotation of rollers 520 and 510. Rollers 520 are coupled to a second set of rollers 520' by a cord 522. Cord 522 may comprise a band of elastic, metal, or a wide range of flexible materials. In this manner, when gear 526 is rotated, both sets of rollers 520 and 520' rotate in the same direction as shown in FIG. 5B. A similar arrangement exists for rollers 510 and a second set of rollers 510', which are coupled together by a cord 512. Hence, the rotation of gear 516 results in a rotation of bar 514 and rollers 510. The second set of rollers 510' rotate in the same direction as rollers 510, as a result of cord 512.

As can be seen in FIG. 5B, sheet 590 is received between rollers 510 and 520 and drawn into first folder 500. In one embodiment sheet 590 contacts rotating cords 512 and 522 and is drawn into first folder 500. Sheet 590 is drawn over a gap 564 and partially drawn over a series of rollers 530 and under a series of rollers 540. Rollers 530 are coupled to a second set of rollers 530' by a cord 532. Preferably, rollers 530, 530', 510 and 510' rotate in the same direction. In one embodiment, when sheet 590 is approximately centered over gap 564, a knife blade 560 is actuated to engage sheet 590 as shown in FIG. 5C.

In one embodiment, sheet 590 engages a stop bar 566 as best seen in FIG. 5B. Stop bar 566 may comprise a wide range of materials and dimensions. For example, in one embodiment, stop bar 515 comprises a generally comb-shaped bar having a plurality of fingers 568 which extend between adjacent cords 532 and/or between cords 532 and the side of folder 500. Stop bar 566 is slidably positioned prior to operation of system 100 so that when sheet 590 registers against stop bar 566, or one or more fingers 568, an approximate middle of sheet 590 overlies knife blade 560. In this manner, once actuated, knife blade 560 performs a half-fold of sheet 590. It will be appreciated by those skilled in the art that stop bar 566 may be otherwise positioned, so that the middle of sheet 590 is not over knife blade 560 when knife blade 560 is actuated to perform a first fold. Further, the location of stop bar 566 may be adjusted so that a single folder 500 may accommodate and fold different sizes of paper sheets 590.

Knife blade 560 may comprise a wide range of materials, including, plastics, metals and the like. Knife blade 560 may have a length that extends a full width of first folder 500, or a portion of the width of first folder 500. In one embodiment, the length of knife blade 560 is at least as long as the width of sheet 590. As shown in FIGS. 5B and 5C, knife blade 560 is coupled to a movement mechanism or actuator 562 designed to impart an up-and-down movement of knife blade 560 as shown by arrows 566. Actuator 562, in one embodiment, is a pneumatically driven actuator 562. In this manner, air pressure is used to translate knife blade 560 as shown in FIGS. 5B–5D. Other movement mechanisms, including electric solenoids, cam drivers, and the like, are used in place of actuator 562 in other embodiments of the present invention.

Figure 5C:
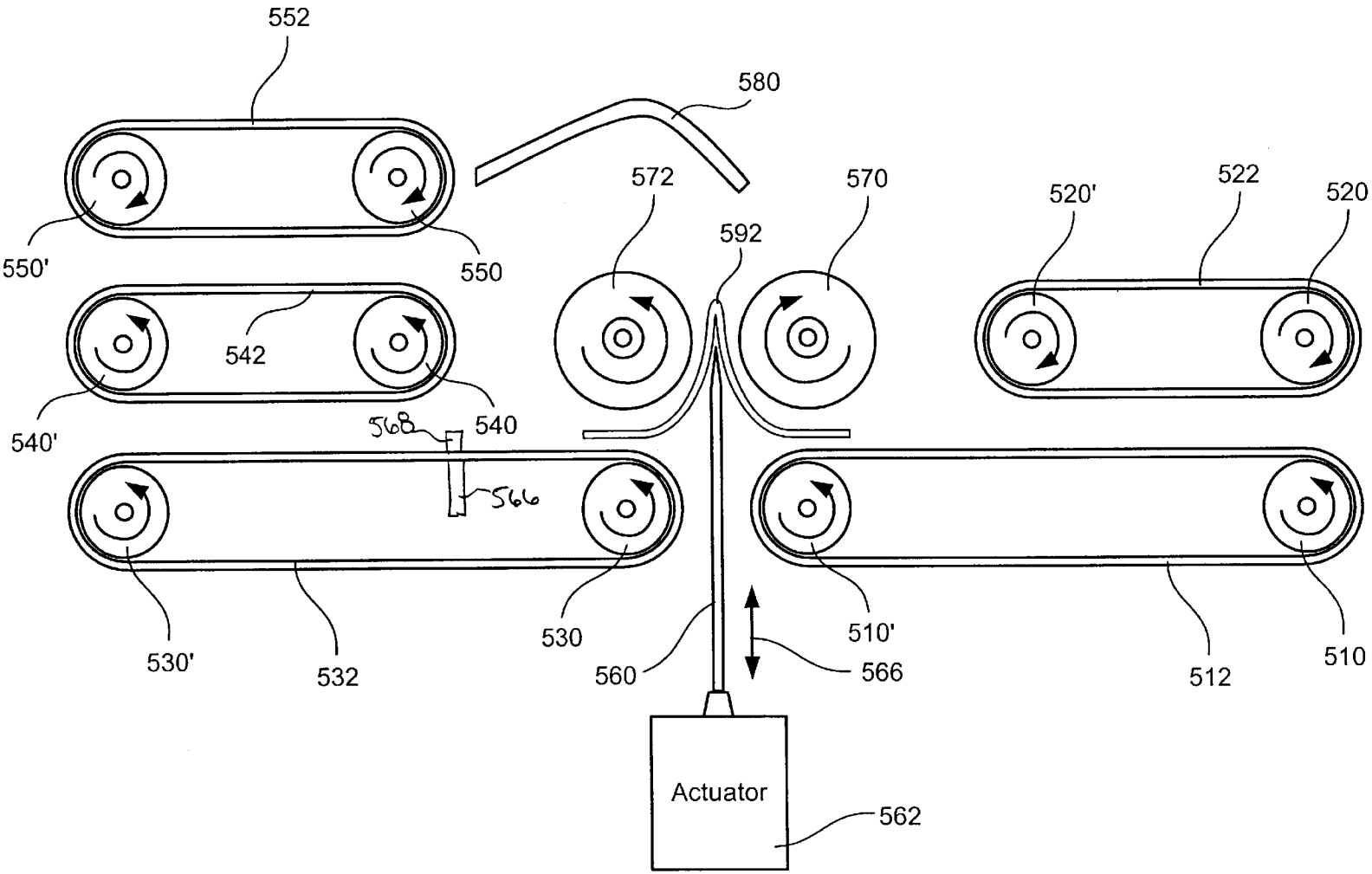
Figure 5D:
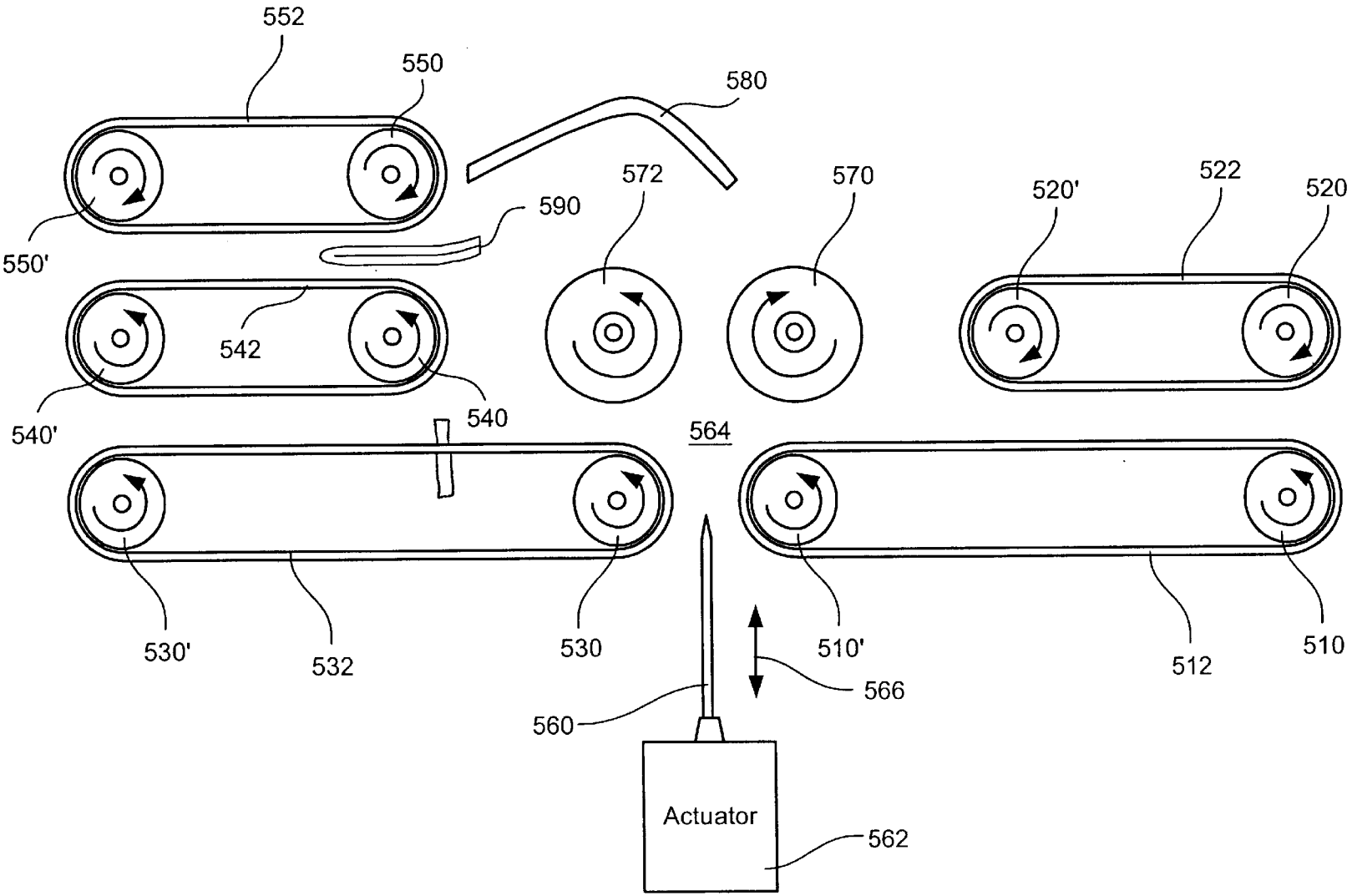

As best shown in FIG. 5C, knife blade 560 engages the undersurface of sheet 590 and causes sheet 590 to be drawn up into and between two rotating rollers 570 and 572. In one embodiment, knife blade 560 extends at least partially between rollers 570, 572 to ensure sheet 590 engages rollers 570, 572. In one embodiment, rollers 570 and 572 are decoupled, namely, rollers 570 and 572 are each separately driven. In another embodiment, rollers 570 and 572 have gear mechanisms engaging one another to provide for nearly identical rotation speeds of rollers 570 and 572, albeit in opposite directions. As the folded sheet 590 engages rollers 570 and 572, it is drawn between rollers 570 and 572 so that a folded edge 592 of sheet 590 engages a deflector 580 positioned above rollers 570 and 572. Deflector 580 is configured and positioned to deflect the now folded sheet 590 to the left as shown in FIG. 5D.

The folded sheet 590 is drawn into and between one or more rollers 540 and 550. In one embodiment, rollers 550 are coupled to a second set of rollers 550' by a cord 552. Similarly, rollers 540 are coupled to a second set of rollers 540' by a cord 542. In one embodiment, each pair of rollers 540, 540' have a separate cord 542. Rollers 550, 550', 540 and 540' operate in a similar fashion as rollers 510, 50', 520 and 520'. For example, in one embodiment, rollers 550' and 540' are coupled to an axle or bar 554 and 544, respectively. Bars 554 and 544 have gear mechanisms 556 and 546, respectively, disposed at one or more positions therealong. In one embodiment, gear mechanisms 556 and 546 interlock to provide similar rotation speeds of rollers 540, 540', 550 and 550'. As a result, cords 542 and 552 have similar rotation speeds in that embodiment. The now folded sheet 590 is drawn by cords 542, 552 and/or rollers 540, 540', 550 and 550' into second sheet translation component 600 as can be seen in FIGS. 2B and 6.

Second sheet translation component 600 includes a plurality of rollers 610. In one embodiment, rollers 610 are coupled to adjacent rollers by a plurality of cords 620 as shown in FIG. 6. In this manner, a rotation mechanism may be coupled to one or more rollers 610, but produce similar rotation of all rollers 610. Sheet 590, having a first fold, enters component 600 as shown by arrow 640 and may engage a brush bar 630. Brush bar 630 operates to help maintain sheet 590 on rollers 610. In one embodiment, sheet 590 travels at least partially under brush bar 630 so that folded edge 592 contacts a register bar 660. Edge 592 registers against register bar 660 to properly align sheet 590 for transfer towards second folder 800.

Figure 6:
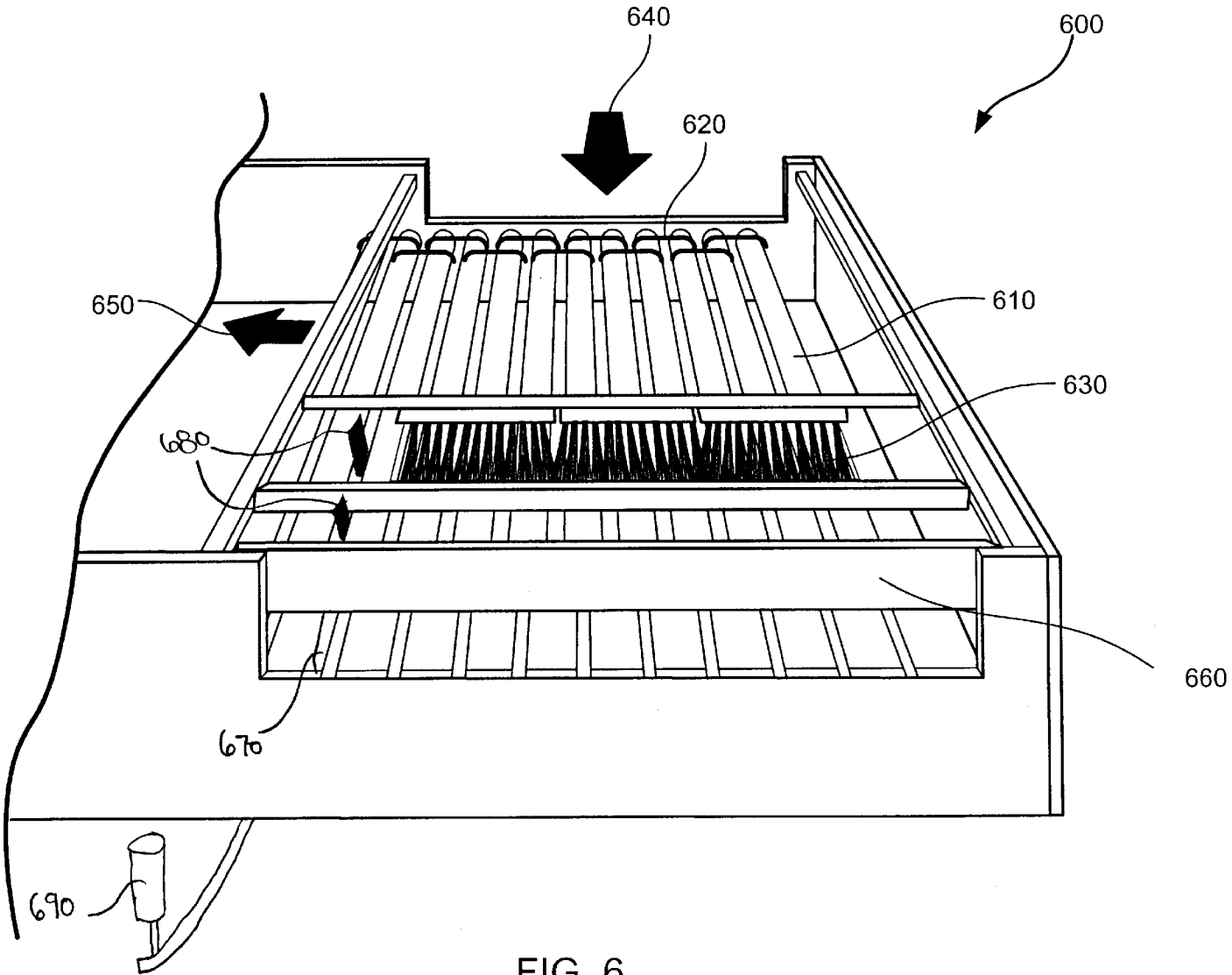
FIGS. 6 and 7 depict simplified overall views of two sheet translation components which effectuate an approximate right angle turn of the individual sheet through the system of FIG. 1.
Figure 7:
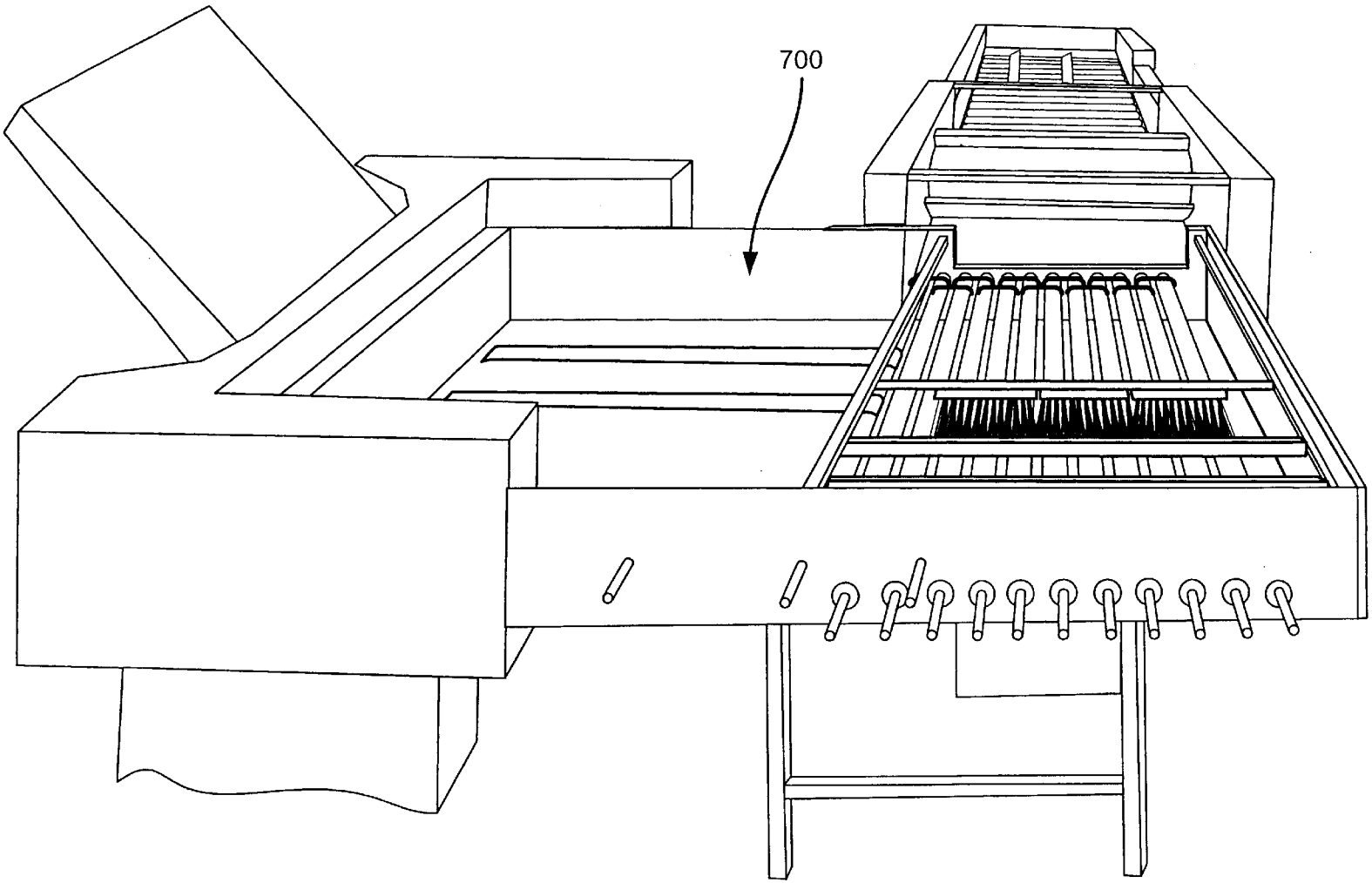
Figure 8:
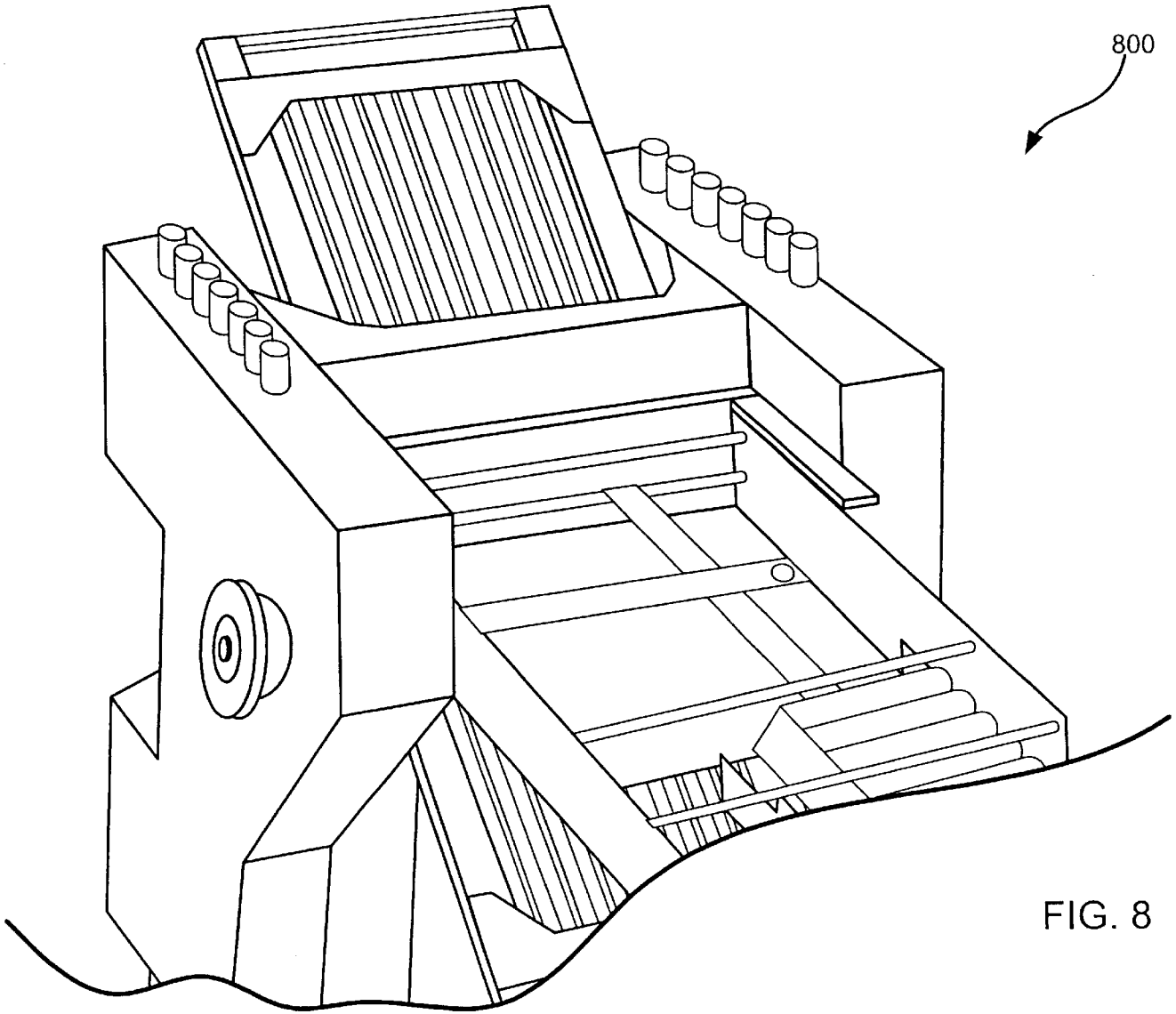
FIG. 8 is a simplified overall view of a second folder according to the present invention.

In one embodiment, sheet 590 registers against a stop bar 670 as can be seen in FIG. 6. In one embodiment stop bar 670 has one or more fingers 680 against which sheet 590 registers. Stop bar 670 is coupled to an actuation device 690, which in one embodiment is an air-controlled or pneumatic device 690. Stop bar 670 is actuated so that bar 670 and/or fingers 680 provide a structure against which sheet 590 registers, and release sheet 590 for transfer to second folder 800. In this manner, stop bar 670 helps ensure sheet 590 is properly aligned for transfer to the second folder 800 after undergoing an approximately ninety degree (90°) turn through second sheet translation component 600. Sheet 590 exits component 600 as shown by arrow 650 as a result of the rotation of rollers 620. In this manner, translation component 600 effectuates an approximately ninety degree (90°) turn in the course of travel of sheet 590. Sheet 590 enters a third sheet translation component 700 as can be seen in FIG. 7. Translation component 700 passes the single-folded sheet 590 to a second folder 800 as can be seen in FIG. 2B and FIG. 8.

Second folder 800 performs a second fold of sheet 590. In one embodiment, the second fold is a half fold of sheet 590. In other embodiments, second folder 800 performs at least a second fold and a third fold of sheet 590. For example, second folder 800 may effectuate a C-fold, a Z-fold, or other types of folds known to those skilled in the art. In one embodiment, second folder 800 performs a second fold of sheet 590 so that the second fold is approximately orthogonal to the first fold created by first folder 500. In this manner, larger sheets of paper may be processed through system 100 than may otherwise be possible should the first and second fold be parallel in relation. In one embodiment, second folder 800 is a buckle plate folder. In a particular embodiment, buckle plate folders are MBO folders available from MBO America, headquartered in Westampton, N.J., as well as from other suppliers.

In a particular embodiment, the sheet includes first and second portions, with the first portion including a customer statement and the second portion including one or more checks, such as convenience checks. In this embodiment, the first fold may be formed between the first and second portions, with the second folder 800 performing folds between the checks. It will be appreciated by those skilled in the art that the first and second portions may contain different information than described above. For example, the first or second portion may include any combination of advertisements, a customer account agreement, checks, a customer statement, or the like. In one embodiment the first and second folds are performed such that a customer name and address printed on the sheet are positioned such that they are visible through a window in an envelope into which the folded sheet is inserted.

In one embodiment, folded sheets 590 exit second folder 800 and are directed to an inserter 850 as shown schematically in FIG. 1. Inserter 850 may be a wide range of inserters designed to insert a folded sheet into an envelope. Exemplary inserters 850 for use with the present invention include those described in the three applications previously incorporated herein by reference in the "Cross References To Related Applications" section of the present application.

Systems according to the present invention provide one or more advantages over the prior art. System 100 is a more cost effective system requiring a lower level and/or greater ease of maintenance than systems which print directly on individual sheets. Further, the cost of printing on a continuous sheet paper is considerably less than printing on individual sheets, and faster than printing on individual sheets. In this manner, the cost of processing a statement through systems of the present invention may be on the order of 25% of the cost of processing a similar statement through prior-art systems that print on individual sheets prior to folding.

The invention has now been described in detail for purposes of clarity and understanding. However, it will be appreciated that certain changes and modifications may be practiced within the scope of the appended claims.

What is claimed is:

1. A sheet folding system comprising:

a separator adapted to separate an individual sheet from a continuous form sheet;

a receiver adapted for receiving said individual sheet;

a first folder, said first folder adapted to perform a first fold of said individual sheet;

a second folder, said second folder adapted to perform a second fold of said individual sheet, wherein the first and second folders comprise two different types of folders; and a sheet transfer mechanism coupled to and between the first folder and the second folder, the sheet transfer mechanism defining a generally right angle alignment between the first and second folders to reduce a system footprint.

2. The sheet folding system as in claim 1 wherein said first folder is a knife folder.

3. The sheet folding system as in claim 2 wherein said knife folder comprises:

a knife blade coupled to a movement mechanism;

a pair of rollers adapted to at least partially receive said knife blade and said individual sheet therebetween; and a deflector positioned on a side of said pair of rollers that is generally opposite said knife blade, said deflector adapted to deflect said individual sheet having said first fold.

4. The sheet folding system as in claim 3 wherein said movement mechanism comprises a pneumatic movement mechanism.

5. The sheet folding system as in claim 1 wherein said first fold is a fold of said individual sheet along a first direction.

6. The sheet folding system as in claim 5 wherein said second fold is a fold of said individual sheet along a second direction.

7. The sheet folding system as in claim 6 wherein said first and second directions are generally orthogonal.

8. The sheet folding system as in claim 1 wherein said second fold is a half fold.

9. The sheet folding system as in claim 1 wherein said second fold is a C-fold.

10. The sheet folding system as in claim 1 wherein said second fold is a Z-fold.

11. The sheet folding system as in claim 1 wherein said second folder comprises a buckle plate folder.

12. The sheet folding system as in claim 1 further comprising a printer coupled to said separator, said printer adapted for printing alphanumeric characters on said continuous form sheet.

13. The sheet folding system as in claim 1 further comprising an inserter coupled to said second folder, said inserter adapted to insert said folded individual sheet into an envelope.

14. The sheet folding system as in claim 1 further comprising a controller coupled to said first and second folders.

15. The sheet folding system as in claim 1 further comprising an edge remover for removing an edge of said individual sheet.

16. A sheet folding system comprising:

a receiver adapted for receiving a sheet to be folded; and a knife folder coupled to said receiver and adapted to perform a first fold of said sheet, said knife folder comprising:

a knife blade coupled to a pneumatic movement mechanism;

a pair of rollers adapted to at least partially receive said knife blade and said sheet therebetween; and a deflector positioned on a side of said pair of rollers that is generally opposite said knife blade, said deflector adapted to deflect said sheet having said first fold;

a second folder coupled to the knife folder and adapted to perform a second fold of the sheet, wherein the second fold is generally orthogonal to the first fold; and an inserter coupled to the second folder, the inserter adapted for inserting the folded sheet into an envelope.

17. The sheet folding system as in claim 16 further comprising a sheet transfer mechanism coupled to and between said knife folder and said second folder, said sheet transfer mechanism defining a generally right angle alignment between said knife folder and said second folder.

18. The sheet folding system as in claim 16 further comprising a separator for separating said sheet to be folded from a continuous form sheet, said receiver being adapted for receiving said sheet from said separator.

19. A method of folding a sheet of paper, said method comprising:

printing on a continuous form sheet;

separating an individual sheet from said continuous form sheet;

performing a first fold of said individual sheet with a knife folder; and performing a second fold of said individual sheet with a second folder, wherein the second folder is not a knife folder;

wherein the first and second folds are generally orthogonal to each other.

20. The method as in claim 19 wherein said performing said first fold comprises pneumatically moving a knife blade in said knife folder to contact said individual sheet.

21. The method as in claim 19 wherein said knife folder for performing said first fold comprises:

a knife blade coupled to a movement mechanism;

a pair of rollers adapted to at least partially receive said knife blade and said sheet therebetween; and a deflector positioned on a side of said pair of rollers that is generally opposite said knife blade, said deflector adapted to deflect said sheet having said first fold.

22. The method as in claim 21 wherein said movement mechanism comprises a pneumatic movement mechanism.

23. The method as in claim 19 further comprising inserting said folded individual sheet into an envelope with an inserter, said inserter coupled to said second folder.

24. The method as in claim 19 wherein said individual sheet further comprises a first portion and a second portion, and wherein said first fold is positioned between said first and second portions.

25. The method as in claim 24 wherein said printing comprises printing a customer statement on said first portion and printing at least one check on said second portion.

26. A method of folding a sheet of paper, the method comprising:

printing on a continuous form sheet;

separating an individual sheet from the continuous form sheet;

performing a first fold of the individual sheet with a knife folder; and performing a second fold of the individual sheet with a second folder;

wherein the individual sheet further comprises a first portion and a second portion, and wherein the first fold is positioned between the first and second portions; and wherein the printing comprises printing a customer statement on the first portion.

27. The method as in claim 26 father comprising printing at least one check on the second portion.

* * * * *